US005136797A

United States Patent [19]

Hildebrandt

[11] Patent Number: 5,136,797

[45] Date of Patent: Aug. 11, 1992

[54] FRAME HAVING SHIFTABLE BARS WITH FLEXIBLE ENDS FOR SECURING FABRIC USING ADHESIVE

[76] Inventor: Greg A. Hildebrandt, R.R. 1, Box 387, Winamac, Ind. 46996

[21] Appl. No.: 702,362

[22] Filed: May 15, 1991

Related U.S. Application Data

[63] Continuation of Ser. No. 405,722, Sep. 9, 1989, abandoned.

[51] Int. Cl.[5] ..... D06C 3/08; B41N 1/24

[52] U.S. Cl. ..... 38/102.91; 38/102.1; 101/127.1; 101/415.1

[58] Field of Search ..... 156/160, 229, 494; 38/102–102.91; 101/127.1, 128, 128.1, 415.1, 128.4; 160/374.1, 375, 376, 381, 368.1, 369, 371, 382, 391, 392, 395, 400; 209/403, 404, 405, 408

[56] References Cited

U.S. PATENT DOCUMENTS

| | | | |
|---|---|---|---|
| 1,093,136 | 4/1914 | Jucker et al. | 38/102.2 |
| 1,252,125 | 1/1918 | Krafft | 38/102.4 |
| 2,149,985 | 3/1939 | Tepper | 160/374.1 |
| 2,244,473 | 6/1941 | Osborn | 160/378 |
| 2,565,218 | 8/1951 | Freeborn | 101/415.1 |
| 2,566,919 | 9/1951 | Black et al. | 101/415.1 |
| 2,693,205 | 11/1954 | Coulter | 101/128.1 |
| 2,802,419 | 8/1957 | Gramatzky | 101/415.1 |
| 2,893,162 | 7/1959 | Knowles | 38/102.1 |
| 2,925,774 | 2/1960 | Scheeler | 101/127.1 |
| 3,029,946 | 4/1962 | Wright et al. | 209/405 |
| 3,176,843 | 4/1965 | Hoskins et al. | 101/127.1 |
| 3,255,540 | 6/1966 | Gilman | 38/102.91 |
| 3,273,497 | 9/1966 | Rosema et al. | 101/128.1 |
| 3,359,663 | 12/1967 | Black et al. | 38/102.91 |
| 3,414,994 | 12/1968 | Jaccard et al. | 38/102.91 |
| 3,422,554 | 1/1969 | Prinzhorn | 101/127.1 |
| 3,463,587 | 8/1969 | Oltra et al. | 101/127.1 |
| 3,477,574 | 11/1969 | Malfroy | 209/403 |
| 3,482,343 | 12/1969 | Hamu | 101/127.1 |
| 3,485,165 | 12/1969 | Hughes | 101/127.1 |
| 3,507,062 | 4/1970 | Moyer | 38/102.91 |
| 3,541,957 | 11/1970 | Bubley | 101/127.1 |
| 3,553,862 | 1/1971 | Hamu | 38/102.1 |
| 3,601,912 | 8/1971 | Dubbs | 38/102.91 |
| 3,608,482 | 9/1971 | Bubley | 101/127.1 |
| 3,608,484 | 9/1971 | Bubley | 101/127.1 |
| 3,788,216 | 1/1974 | Lambert | 101/127.1 |
| 3,908,293 | 9/1975 | Newman | 38/102.91 |
| 3,914,887 | 10/1975 | Newman | 38/102.8 |
| 3,962,805 | 6/1976 | Hamu | 101/127.1 |
| 3,991,677 | 11/1976 | Barnes | 101/127.1 |
| 4,041,861 | 8/1977 | Alter | 101/127.1 |
| 4,186,660 | 2/1980 | Key | 101/128.1 |
| 4,301,853 | 11/1981 | Vidal | 38/102.5 |
| 4,341,255 | 7/1982 | Mock | 160/369 |
| 4,345,390 | 8/1982 | Newman | 38/102.91 |
| 4,409,749 | 10/1983 | Hamu | 38/102.3 |
| 4,430,814 | 2/1984 | Wulc | 101/127.1 |
| 4,430,815 | 2/1984 | Wulc | 101/127.1 |
| 4,442,772 | 4/1984 | Bubley | 101/127.1 |
| 4,462,174 | 7/1984 | Messerschmitt | 101/127.1 |
| 4,525,909 | 7/1985 | Newman | 38/102.91 |
| 4,539,734 | 9/1985 | Messerschmitt | 38/102.91 |
| 4,568,455 | 2/1986 | Huber et al. | 101/127.1 |
| 4,571,864 | 2/1986 | Bopp | 101/127.1 |
| 4,710,051 | 12/1987 | Karmazin | 209/403 X |
| 4,860,467 | 8/1989 | Larson | 101/127.1 |
| 4,991,640 | 2/1991 | Verkindt et al. | 160/368.1 |

OTHER PUBLICATIONS

"Sure-Lock Metal Chase", Screen Printing, Aug. 1977, p. 59.

*Primary Examiner*—Werner H. Schroeder
*Assistant Examiner*—Ismael Izaguirre
*Attorney, Agent, or Firm*—Thomas J. Dodd

[57] ABSTRACT

A screen printing frame assembly which includes adjustable tensioning bars adjacent the frame peripheral edge. Screen mesh fabric is mounted to the tensioning bars by adhesive and the bars are drawn toward the frame edge to stretch the fabric to a uniform tautness for printing. A mounting tool may be employed to secure the fabric in position prior to gluing to the tensioning bars. Each tensioning bar may also include resilient corner pieces to allow for corner slackening of the fabric.

5 Claims, 4 Drawing Sheets

FRAME HAVING SHIFTABLE BARS WITH FLEXIBLE ENDS FOR SECURING FABRIC USING ADHESIVE

CROSS-REFERENCE TO THE RELATED APPLICATION

This application is a continuation of U.S. patent application Ser. No. 405,722 filed on Sep. 9th, 1989, now abandoned.

BACKGROUND OF THE INVENTION

1. Field of the Invention

This invention relates to screen printing, and will have application to a device and method of securing the fabric mesh to a frame.

2. Description of the Related Art

There are currently two basic methods or systems in use to achieve the mesh or fabric tension required to control screen printing for close tolerance applications. The first system involves the utilization of a print frame constructed of metal which has movable bars mounted adjacent each side of the frame. The mesh is attached to these bars by mechanical clamping or entrapment devices. The bars are provided with mechanical means, such as worm screws, which shift the bars between mounting and working positions. The main problem with these systems is the tendency of the fabric to slip, which causes a shift in image positioning and loss of tension which eliminates the necessary control over the printed image.

The second system involves prestretching of the fabric, after which the fabric is glued to the print frame. The chemical bonding of the fabric and frame is usually strong enough to prevent slippage, however, the rigid one-piece frames used prevent the fabric from being retensioned after printing. Thus, after several printing operations are complete, fatigue and destabilization of the mesh often require premature replacement of the system at a significant cost to the printer.

SUMMARY OF THE INVENTION

The screen printing fabric mounting device and system of this invention combines the salient features of the above two systems to create a unique solution to the problems inherent in each individual system. The apparatus includes a rigid frame to which movable tensioning bars are connected. The exposed surface of each tensioning bar is substantially flat and provides an adequate platform to which the fabric is glued or otherwise chemically attached.

Special mounting tools may be used to pretension and secure the fabric to the tensioning bars prior to application of adhesive. After the adhesive is allowed to set, the mounting tools are removed, the bars are slid into the working position, and print operations commence. The adhesive provides a firm secure bond of fabric-to-bar, while the adjustability of each bar allows for retensioning, when necessary, of the fabric. Each bar may also include flexible corner parts which relieve excessive diagonal tension of the screen.

Accordingly, it is an object of this invention to provide for a novel and improved system for securing fabric mesh to a screen printing frame.

Another object is to provide for a screen printing frame which has a fabric mesh fastened by chemical means to adjustable tensioning bars.

Another object is to provide a system for securing screen printing mesh to a frame which eliminates mesh slippage and which may be retensioned to allow for wear and mesh fatigue.

Still another object is to provide for a mesh securement frame which is durable and which eliminates excessive diagonal mesh tension at the frame corners.

Other objects will become apparent upon a reading of the following description.

BRIEF DESCRIPTION OF THE DRAWINGS

A preferred embodiment of the invention has been depicted for illustrative principles only wherein.

DESCRIPTION OF THE PREFERRED EMBODIMENT

Figure 1:
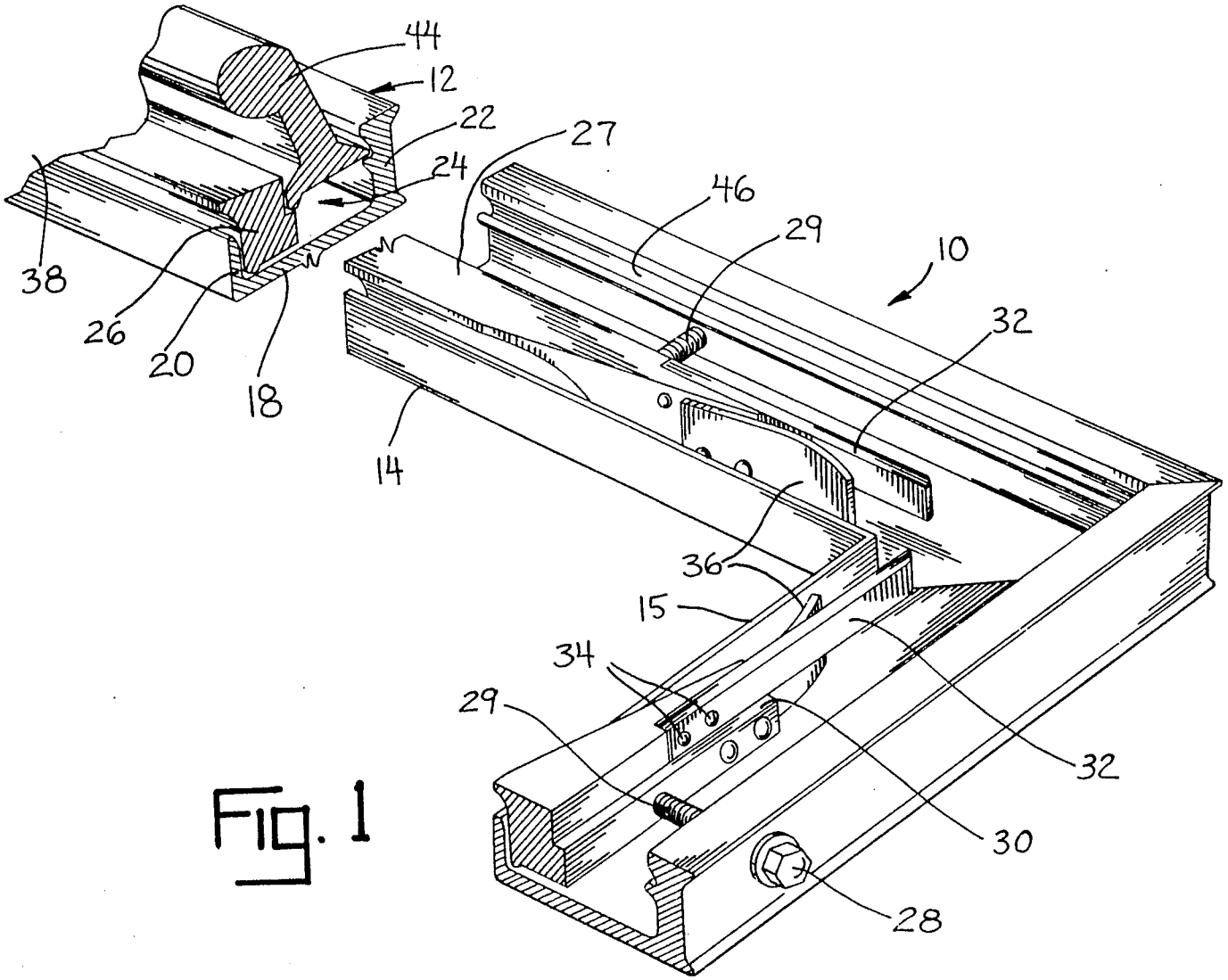
FIG. 1 is a fragmented perspective view of the frame showing the tensioning bars in a set up position.

The preferred embodiment herein described is not intended to be exhaustive or to limit the invention to the precise form disclosed. It is chosen and described to explain the principles of the invention and its application and practical use to enable those skilled in the art to utilize its teachings.

Referring now to the drawings, reference numeral 10 refers generally to the screen tensioning device of this invention. Device 10 includes a rigid frame 12 which is shown as a four-sided rectangular frame in FIG. 3, with interconnected frame parts 14, 15, 16 and 17. In use, the shape of the frame may vary with the type of print job to be performed and is by no means limited to the rectangular shape shown. Since each frame part 14–17 is of substantially identical construction, the configuration and identification of component parts will be limited to the construction of frame part 14 for purposes of clarity.

Figure 4:
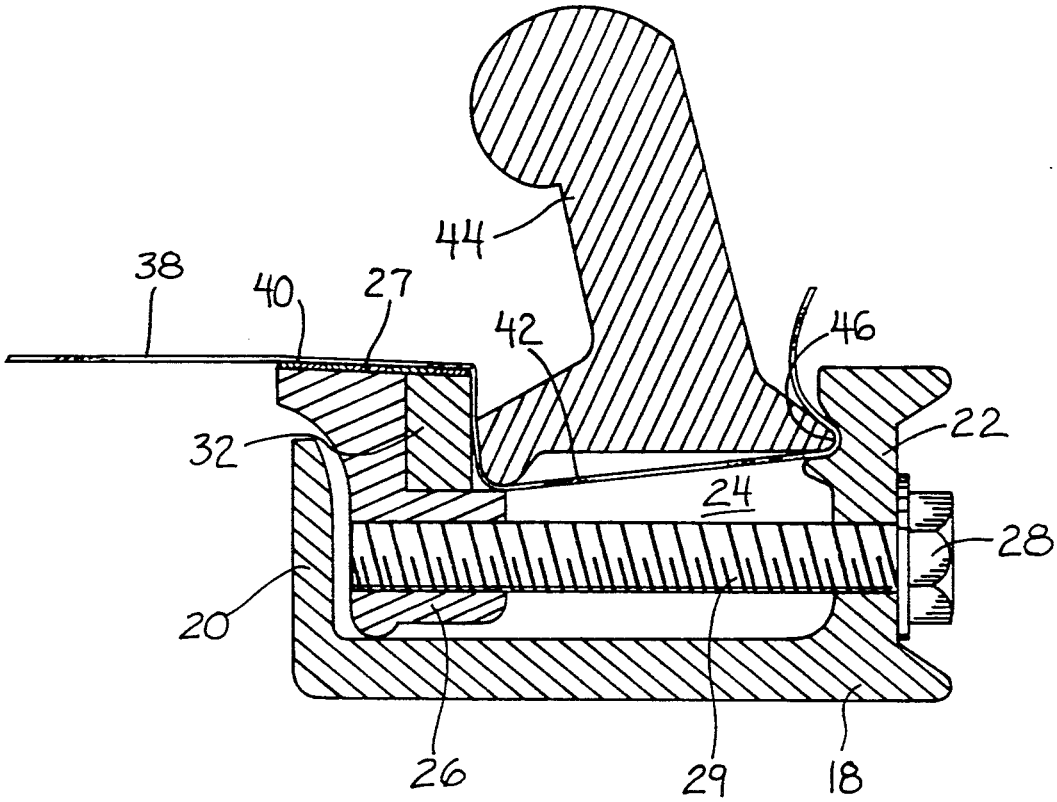
FIG. 4 is a cross-sectional view of the frame illustrating use of the mounting tools.
Figure 5:
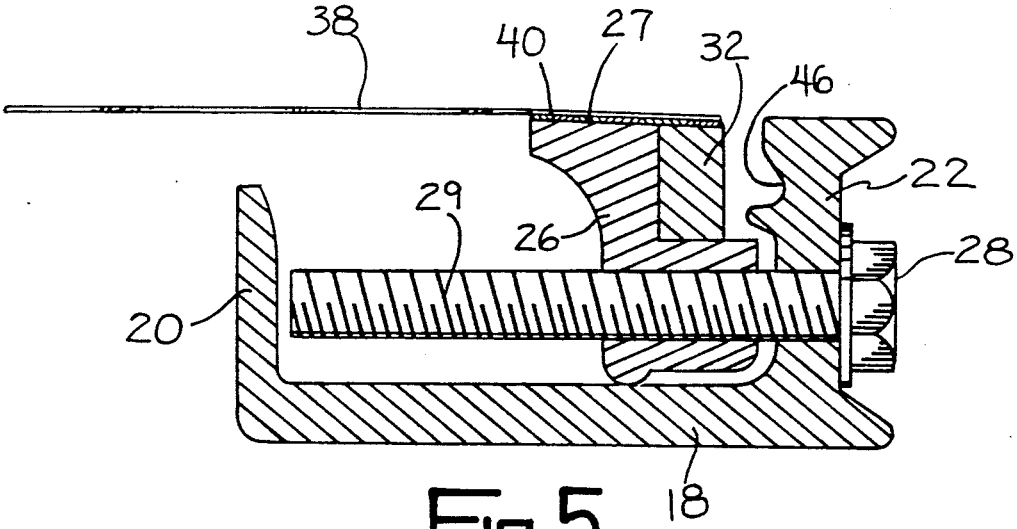
FIG. 5 is a cross-sectional view of the frame with the fabric mounted and the tension bars in a work position.

Frame part 14 is preferably configured as shown in FIGS. 4 and 5 with bottom wall 18, inner side wall 20 and outer side wall 22 to define a channel 24. A tensioning bar 26 is housed in channel 24 and is connected therein through a plurality adjustment screws 28 (four shown) which extends through outer side wall 22 and bar 26. Each tensioning bar 26 is preferably formed of rigid material such as wood or metal and may be stepped at 30 to accommodate a snug fit in frame channel 24 when in the tensioned position of FIG. 5.

A flex bar 32 is connected as by fasteners 34 to each end of tensioning bar 26 and terminates adjacent a corner of the frame 12 as shown. A rigid, curved stop 36 extends from each end of tensioning bar 26 to limit the travel of flex bar 32 which is formed of elastic material such as resilient plastics or metal.

Device 10 is operated as follows to secure a piece of screen mesh 38 for use in screen printing operations. With each tensioning bar 26 in its set up position of FIGS. 1 and 4, mounting tools 44, of a configuration compatible with the stepped portion 30 of each bar 26 and a horizontal channel 46 of each outer side wall 22 are snap-fitted into position over mesh 38 as shown in FIG. 4 to ensure continuous contact between mesh 38 and adhesive surface 27. An adhesive layer 40 is then applied to the top surface 27 of each tensioning bar 26, and to the top surface of the flex bars 32. Adhesive 40 is a common contact type adhesive knonw to those skilled in this art and the exact type of adhesive used will depend upon the type of mesh 38 and the holding strength desired by the printer.

Figure 2:
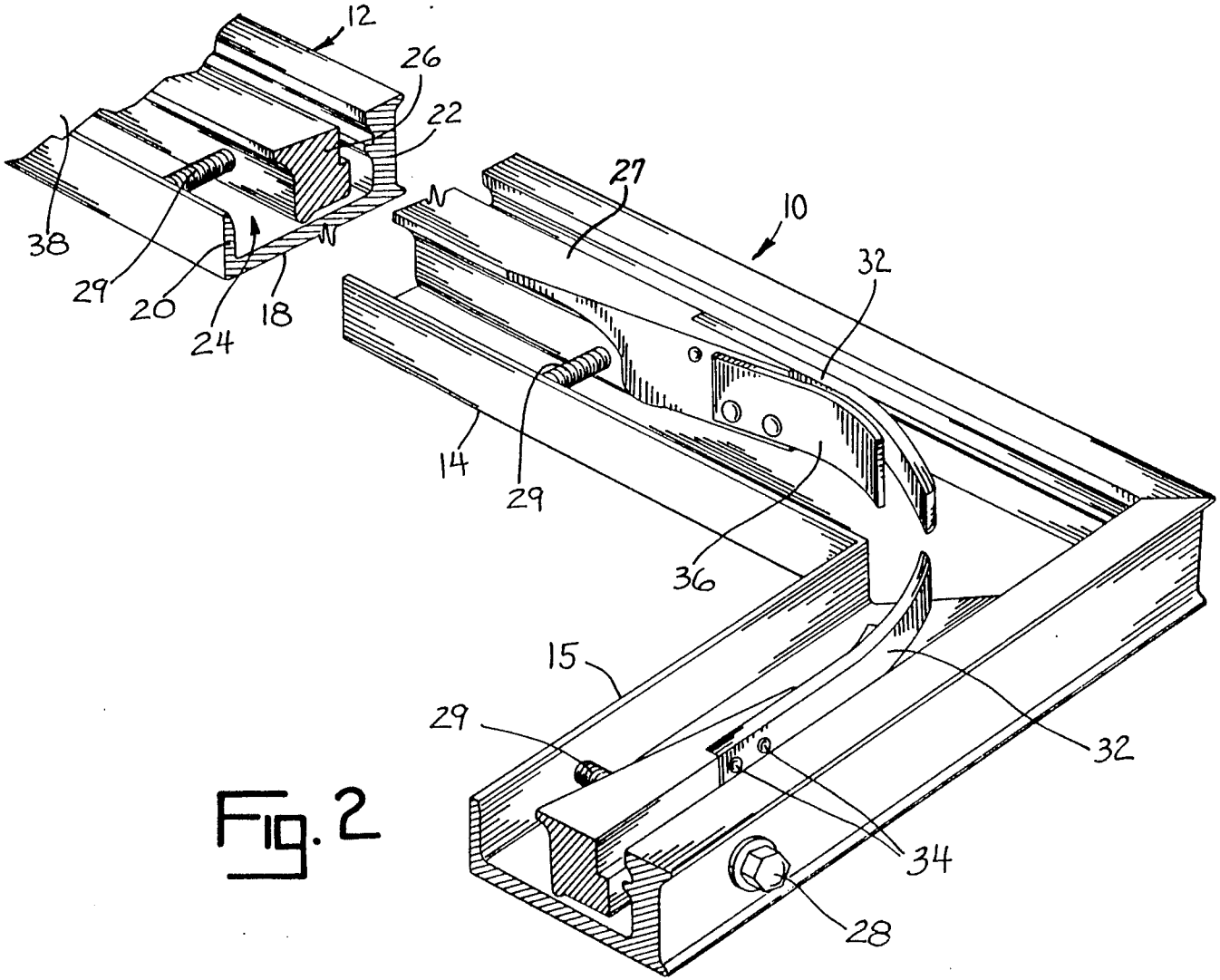
FIG. 2 is a fragmented perspective view of the frame and tension bars in a work position.

After adhesive 40 has been allowed to cure for a time determined by the particular adhesive used, mounting tools 44 are removed. Excess mesh 42 is trimmed and adjustment screws 28 are turned with tensioning bars 26 advancing along screw threads 29 towards outer side wall 22 until the tensioned or work position of FIGS. 2 and 5 is reached. After all bars 26 are in the tensioned position, screen printing is commenced in the usual fashion.

Figure 3:
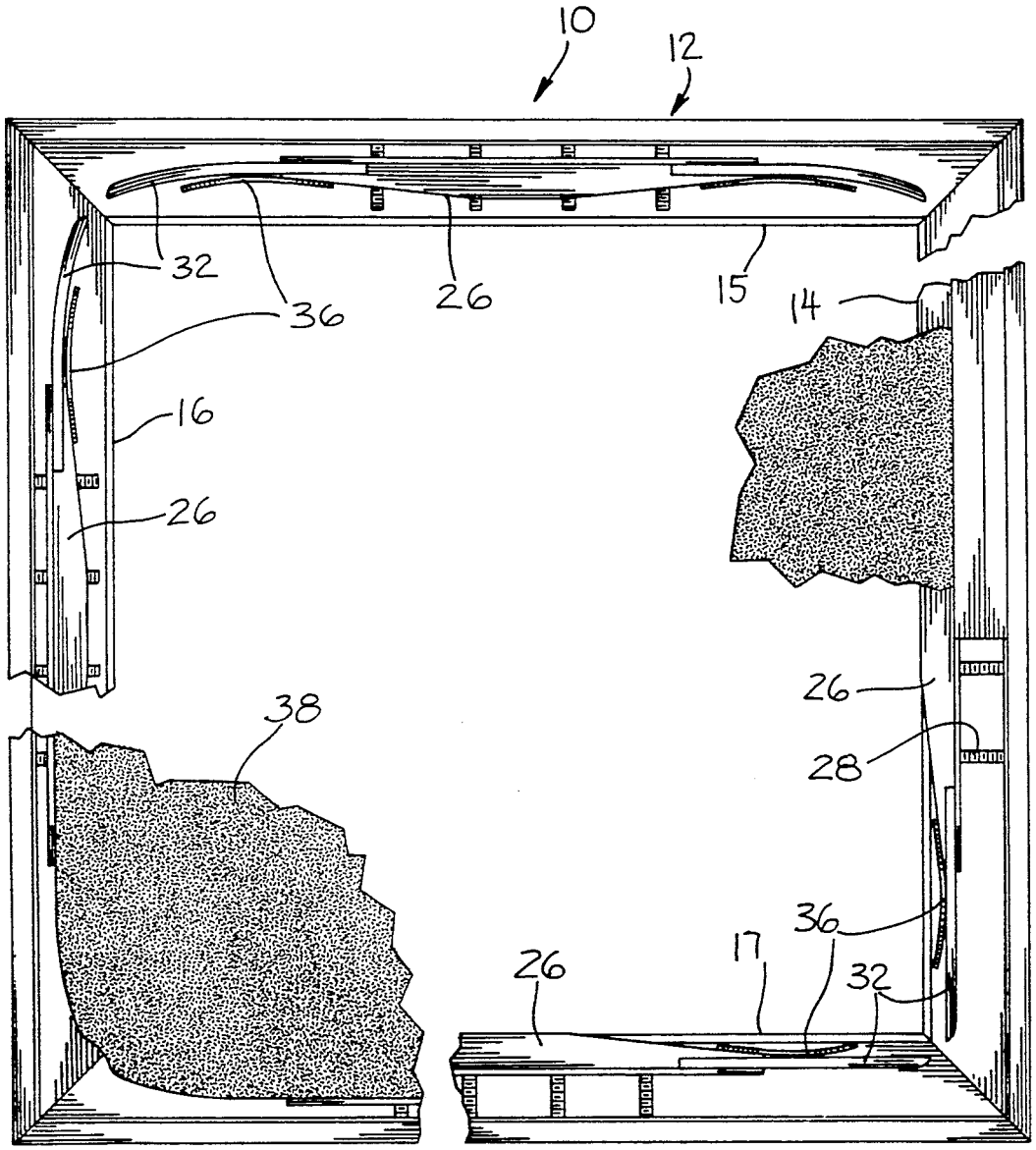
FIG. 3 is a fragmented plan view of the frame with portions of the tension bars in a work position with the fabric mounted and stretched and the other portions of the tension bars in a set up position.

Flex bars 32 which are located in the corners of frame 12 as seen in FIG. 3, flex inwardly as shown in FIG. 2 to accommodate the additional force present at the frame corners as the mesh 38 is stretched and to equalize the corner forces to the same value as the midpoint forces to stabilize the mesh for accurate printing and to minimize the possibility of mesh slippage. Stops 36 limit the amount of bending of the flex bars 32 to maintain adequate tension on the mesh at the frame corners.

Tensioning bars 26 may be retensioned by turning adjustment screws 28 in the manner above described if it becomes necessary to again stretch the mesh after one or more printings have been completed.

It is understood that the above description does not limit the invention to the precise form disclosed but may be modified within the scope of the following claims.

I claim:

1. Apparatus for securing fabric used in screen printing, said apparatus comprising a generally rectangular frame defining a central opening, said frame including interconnected peripheral frame members defining a channel therein, a rigid tensioning bar positioned in each channel, each tensioning bar is shiftable between a set-up position adjacent said central opening and a tensioning position spaced from the central opening, means for shifting each tensioning bar between said set-up position and said tensioning position, each tensioning bar including flexible end members located adjacent a junction of said frame members, means for securing the fabric to each means for securing the fabric to each tensioning bar, end said members absorbing a tensile force imparted by said fabric at each corner of said frame when the tensioning bars are shifted into the tensioning positions.

2. The apparatus of claim 1 wherein each tensioning bar defines a substantially flat planar exposed surface, said fabric secured directly to each tensioning bar by adhesive applied between said fabric and said flat planar upper surface.

3. The apparatus of claim 1, further including a rigid stop member connected to each bar adjacent each end member, said stop member limiting flexing movement of the end member.

4. The apparatus of claim 1 wherein each frame member includes a wall, and first and second spaced flanges extending from said wall to define said channel.

5. Apparatus of claim 4 wherein each bar has a longitudinal peripheral groove facing said first flange, said first flange having a longitudinal groove facing said bar groove, a removable mounting tool having lower tabs fitting into said grooves to clamp said fabric to said bars and securing said fabric to the bars in the set-up position to facilitate application of said adhesive prior to the bars being shifted into said tensioning position.

* * * * *